United States Patent [19]

Adler

[11] Patent Number: 4,739,960

[45] **Date of Patent: * Apr. 26, 1988**

[54] BOOK HOLDER

[76] Inventor: Harold A. Adler, 1457 Eastwind Cir., Westlake Village, Calif. 91361

[ * ] Notice: The portion of the term of this patent subsequent to Jul. 26, 2002 has been disclaimed.

[21] Appl. No.: 422,825

[22] Filed: Sep. 24, 1982

[51] Int. Cl.[4] ..... A47B 97/00

[52] U.S. Cl. ..... 248/453; 24/511; 248/465

[58] Field of Search ..... 248/446, 453, 454, 455, 248/456, 457, 463, 464, 465, 451, 452; 24/201 C, 511

[56] References Cited

U.S. PATENT DOCUMENTS

| | | | |
|---|---|---|---|
| 363,228 | 5/1887 | Hammer | 248/451 |
| 579,992 | 4/1897 | Leiber | 248/451 |
| 1,057,393 | 3/1913 | Morton | 248/453 |
| 2,155,535 | 4/1939 | Elliot | 248/453 |
| 2,609,636 | 9/1952 | Stone | 248/453 |
| 3,141,221 | 7/1964 | Faulls, Jr. | 24/201 C |
| 3,275,281 | 9/1966 | Sampson | 248/465 |
| 3,447,770 | 6/1969 | Gallamos | 248/453 |
| 3,460,795 | 8/1969 | Dahlin | 248/465 X |

FOREIGN PATENT DOCUMENTS

| | | | |
|---|---|---|---|
| 260050 | 2/1968 | Austria | 248/456 |

*Primary Examiner*—J. Franklin Foss
*Assistant Examiner*—David L. Talbott
*Attorney, Agent, or Firm*—Allan M. Shapiro

[57] ABSTRACT

The largest structural member of the book holder is its back which is formed of injection molded flexible synthetic polymer composition material. The support for the back is molded in the plane of the back and is joined thereto by means of living hinge structure. A book clamp is formed so that it faces the back to resiliently engage the edge of a book therebetween. The book clamp is preferably unitarily formed with the back and is pivoted with respect to the back by means of a living hinge.

24 Claims, 2 Drawing Sheets

FIG. 4
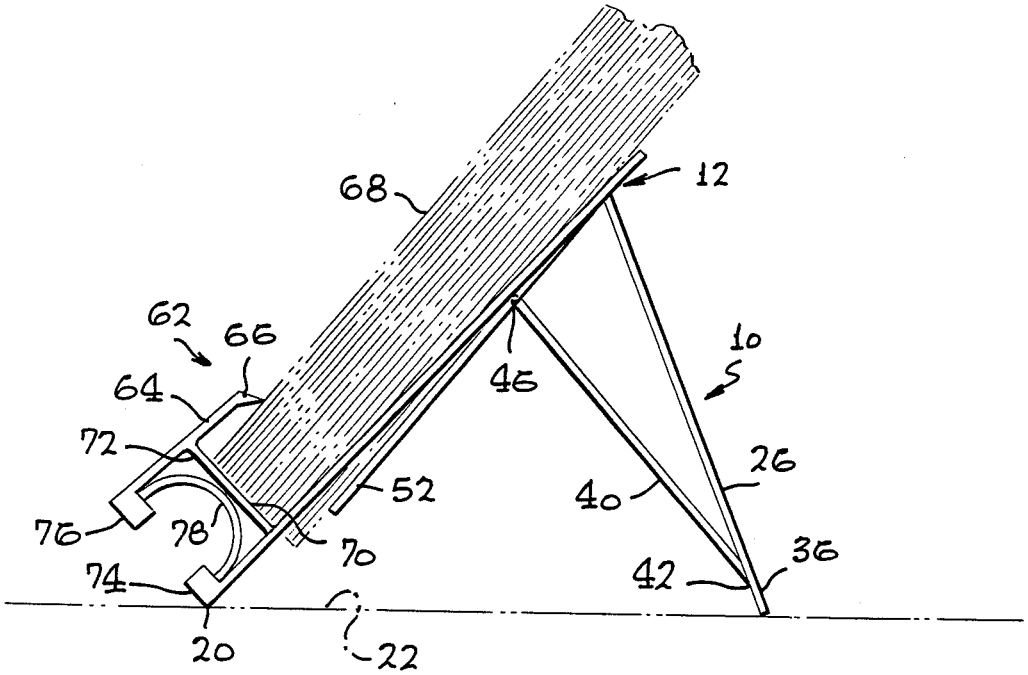
FIG. 5
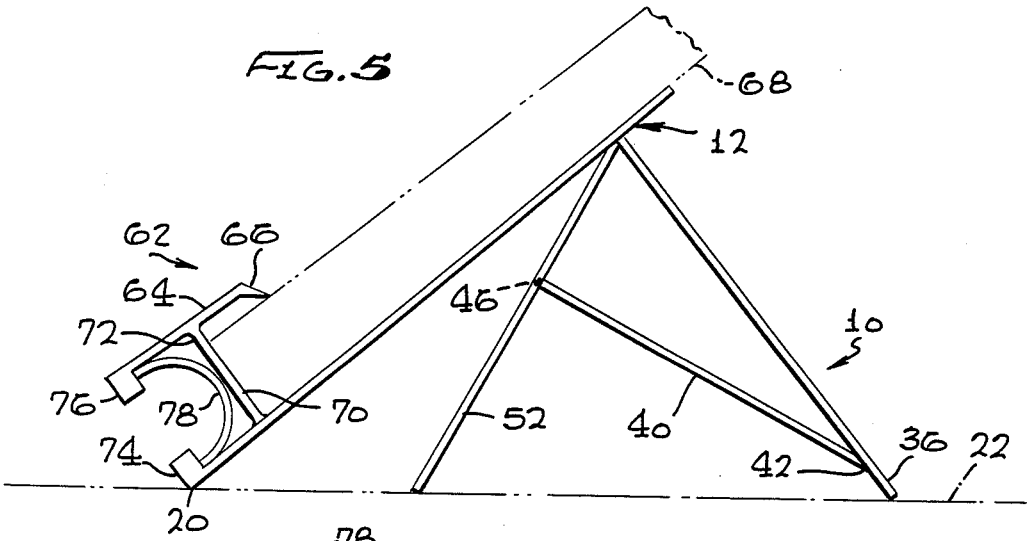
FIG. 9
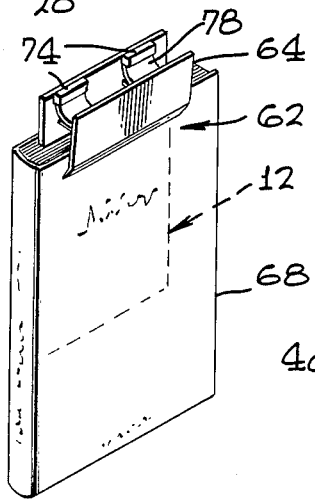
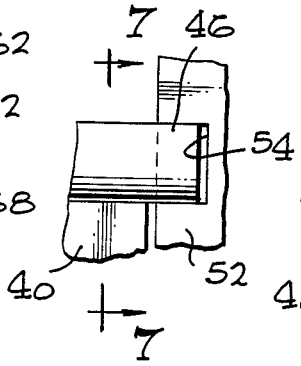
FIG. 6
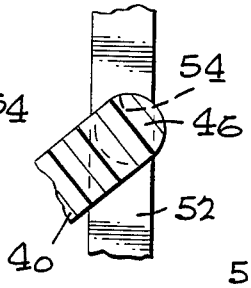
FIG. 7
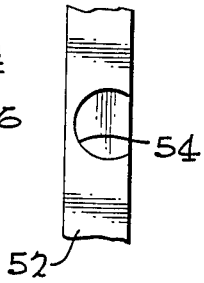
FIG. 8

BOOK HOLDER

BACKGROUND OF THE INVENTION

This invention is directed to a book holder which can attach to a book to function as a book stand, a book mark, and/or a page holder. In the book stand mode, it is organized to support a book in a convenient position for reading.

Some persons have limited mobility and/or strength and, thus, appreciate having a book held in a position where it may be read. Other persons like to use a book holder for the simple convenience of not having to hold the book in the proper reading position. Thus, book holders have been developed. Prior patents include Gallamos U.S. Pat. No. 3,447,770 and Dahlin U.S. Pat. No. 3,460,795 which are principally directed to structures supporting the book holder at an appropriate position. These patents have support structures which are formed out of the back of the book holder. There are some patents which have a member which engages on the front of the book being held, to thus retain the book in position and hold the pages open at the desired place. Such a teaching is found in Stone U.S. Pat. No. 2,609,636 which has a spring-loaded pressure plate. These teachings are useful, but they variously lack the strength, universality of use, or simplicity of construction for providing a reliable book holder which can be inexpensively produced and used for a number of purposes or in a number of positions.

SUMMARY OF THE INVENTION

In order to aid in the understanding of this invention, it can be stated in essentially summary form that it is directed to a book holder having a back and an adjustable support integrally formed with the back together with a book clamp positioned in front of, facing the back and integrally formed therewith. The only separate part provided is a spring for urging the book clamp in the clamping direction.

It is, thus, an object of this invention to provide a book holder which is substantially made of one-piece material, integrally formed and injection molded together of a thermoplastic synthetic polymer composition material which is sufficiently rigid in thick sections to provide a book holder of adequate support and is sufficiently flexible in thin sections to permit the use of living hinges between the book holder back and its support, and between the book holder back and the book clamp.

It is another object to provide a book holder which is also useful as a page holder by clamping the book over its lower edge to hold the book and its pages in place. The book holder is also useful as a book mark wherein it is clamped over the edge of one set of pages to hold those pages in position.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 4 is a side elevational view of the book holder in the normal book support position.

FIG. 5 is a side elevational view of the book holder showing the configuration of the back support under a more heavily loaded condition.

FIG. 6 is an enlarged detail showing the engagement between the back support and the back.

FIG. 7 is a section taken generally along the line 7—7 of FIG. 6.

FIG. 8 is a view of the back as seen generally along the line 7—7 of FIG. 6, but with the back support leg removed.

FIG. 9 is an isometric view showing the book holder of this invention in use as a page holder.

DESCRIPTION OF THE PREFERRED EMBODIMENT

Figure 1:
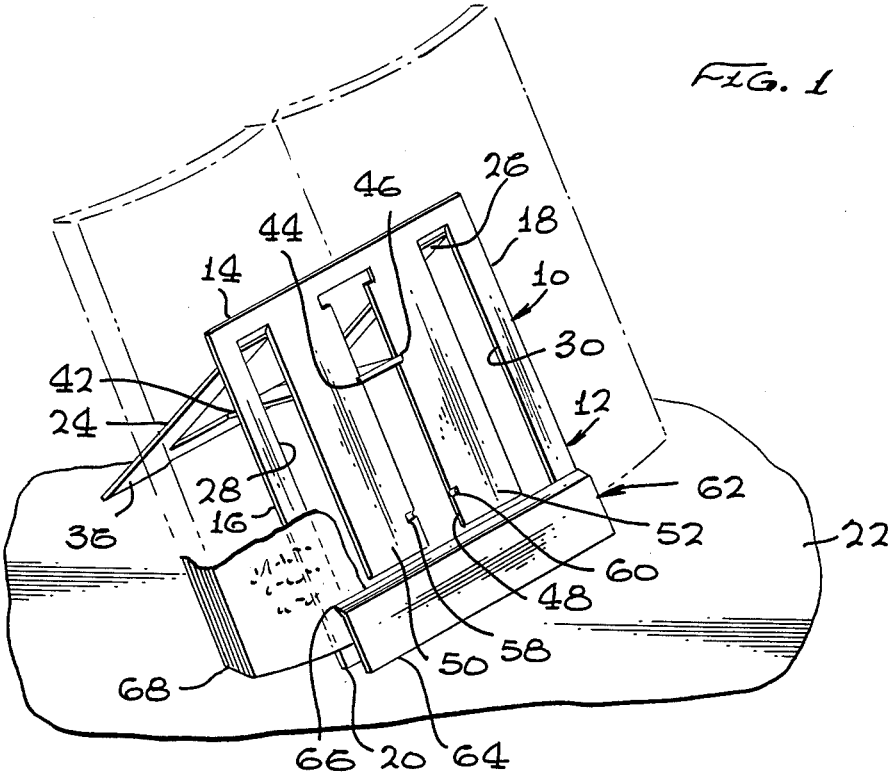
FIG. 1 is a perspective view of the book holder of this invention, showing it holding a book.
Figure 2:
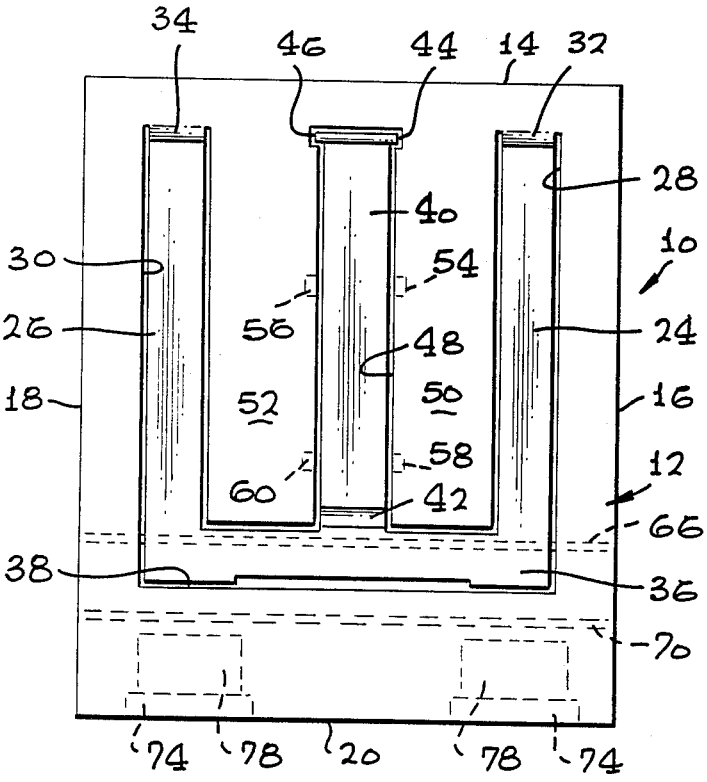
FIG. 2 is a rear elevational view thereof, with the book holder support lying in the plane of the back of the book holder.

The book holder of this invention is generally indicated at 10 in FIGS. 1, 2, 3, 4, 5, and 9. Book holder 10 has back 12 as its major structural element. The back 12 has a substantially rectangular outline and is in the form of a fairly thin injection molded part made of thermoplastic synthetic polymer composition material. The polymer composition material should be moderately rigid, even in the fairly thin structure of the back 12, but should be sufficiently resilient that hinges may be integrally molded as thin sections of the same material. The back 12 is seen from the front in FIG. 1 and from the back in FIG. 2. Back 12 is limited by top edge 14, left and right edges 16 and 18, and bottom edge 20. The bottom edge 20 is preferably straight, as shown in FIG. 2, because it is one of the edges which engages on the supporting surface such as table top 22. Bottom edge 20 may be configured with a recess between its ends, but its ends adjacent the intersection of the bottom with the left and right edges 16 and 18 are full-length to serve as feet. On the other hand, the edges 14, 16 and 18 need not be straight but may be decoratively configured. The back 12 is molded as a substantially flat structure and included in the molding are the means by which the back is supported. Left and right support legs 24 and 26 are respectively formed in slots 28 and 30 which extend downward in the back from adjacent the top edge 14 thereof. The support legs are respectively joined to the back by living hinges 32 and 34 which are formed as a thin section of the injection molded piece. The left and right support legs are joined across the bottom by foot 36 which lies in slot 38. Slot 38 joins the bottom end of slots 28 and 30.

Extending upward from the center of foot 36 is bracket 40. Bracket 40 is integrally molded with the rest of the structure of back 12 and, in the rest position indicated in FIG. 2, lies in the plane of the remainder of the back. Bracket 40 is attached to foot 36 by means of living hinge 42 which is a thin section of the molded part. The upper end of bracket 40 carries a substantially cylindrical bar which has fingers 44 and 46 extending laterally outward past the edges of bracket 40. The finger 46 is shown in more detail in FIGS. 6 and 7. Bracket 40 is formed in slot 48 in the back, as is seen in FIGS. 1 and 2. The several slots in the structure of back 12 form two downwardly directed tongues 50 and 52. These tongues are joined with the remainder of the back with the full thickness of the material of the back. Thus, they are structural elements of the back. As is seen in FIG. 2, the fingers 44 and 46 are longer than the width of slot 48 and, thus, overlap the tongues. The tongues carry pairs of recesses into which the fingers can be snapped. In FIG. 1, the fingers are respectively snapped into recesses 54 and 56, which are shown in FIG. 2. There is another pair of receses 58 and 60 farther down on the tongues adjacent the free ends thereof. The recesses are snap recesses in the resilient material. As is seen in FIG. 8, the recesses are open from the front of back 12 and are slightly smaller where the recess intersects the front surface of back 12 than the diameter of the fingers 44 and 46 which can be snapped in and out of the recesses. When bracket 40 is pulled forward out of its slot 48 to swing on its hinge 42 and foot 36 is pulled rearwardly of the back to swing on its hinges 32 and 34, the fingers 44 and 46 can be snapped into recesses 54 and 56 to achieve the configuration shown in FIGS. 1 and 4. A triangle is formed of the support legs, the bracket 40 and the upper portion of the tongues down to the recesses 54 and 56 to hold the foot 36 in a support position away from the back. In this configuration, the foot 36 and bottom edge 16 of back 12 provide a support for the structure.

Figure 3:
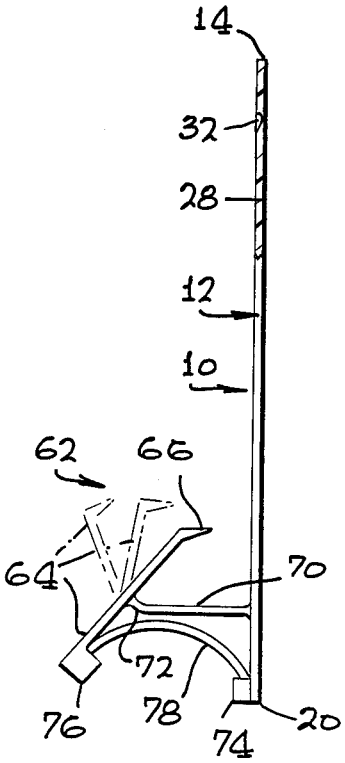
FIG. 3 is a side elevational view of the book holder in the rest position.

Book clamp 62 is best shown in FIGS. 1, 3, 4 and 5. Except for its spring, the book clamp is integrally molded with the back. Book clamp 62 comprises clamp bar 64 which has a clamp jaw 66 formed thereon. Clamp jaw 66 is an inwardly directed tooth oriented to engage on the front of the book 68 held beneath the clamp bar. Clamp bar 64 is mounted on flange 70 which extends all across the back 12 below slot 38. The flange 70 has substantially the same thickness as the back and, thus, is a firm structural member. The portion of flange 70 adjacent clamp bar 64 is thin to define living hinge 72. This hinge permits swinging motion of the clamp bar 64 on the hinge, as is shown in FIG. 3. The angle of jaw 66 and the amount of swinging permitted to the clamp bar 64 is such to permit the jaw to engage and clamp upon books which are thicker than the width of flange 70, as is indicated in the most counterclockwise direction of the clamp bar in FIG. 3. Spring abutment 74 is a rail formed on the front side of back 12 adjacent its lower edge 16. Spring abutment 76 is similar and is formed on the back of clamp bar 64 adjacent its lower edge. One or more resilient flat springs 78 are resiliently bent upward into the space below flange 70 and has its ends seated on the spring abutments. The tendency for the flat spring 78 to flatten out causes clockwise resilient clamping force to the clamp bar 64, in the direction seen in FIGS. 3, 4 and 5. The character of the one or more springs 78 is a function of its strength. The spring 78 may be made of metallic or synthetic polymer material.

There are several principal uses for the book holder 10 of this invention. In FIG. 9, the book holder 10 is illustrated as being a page mark or holder for the book 68. In that usage, the support legs 24 and 26 as well as bracket 40 are folded into the plane of the back and the back 13 is inserted into the book at the page to be retained. Clamp bar 64 is engaged over the front or back of the book for secure retention. As a book stand, the support legs 24 and 26 are pulled out to the back, and bracket 40 is snapped into place. The selection of recesses 54 and 56 as compared to recesses 58 and 60 is a function of the desired angle of the back while supporting the book. As a book support, if the clamp bar is not engaged over the book, the book may stand on the top of clamp jaw 66 when the clamp bar is in the spring-relaxed position shown in FIG. 3. This merely supports the book at the desired angle. However, when it is desired that book holder 10 act as a page holder, the book 68 is opened to the desired pages, and book clamp 62 is opened by squeezing together on the bottom of clamp bar 64 with respect to the bottom of back 12, to open clamp jaw 66. Thereupon, the book is slipped under the clamp jaw at the desired pages and the clamp jaw is released. Now, the book holder 10 is permitted to rest back on its foot 36 to support the open book at the desired pages. The pages will be retained. This is the configuration shown in FIGS. 1 and 4.

Bookholder 10 has an additional feature for books which are of substantial weight. It must be noted that tongues 50 and 52 are unattached at the bottom and that bracket 40 has its fingers snapped into recesses in those tongues. Thus, when the load becomes heavier, as is indicated in FIG. 5, the tongues 50 and 52 bend out of the plane of back 12 until they also engage on table top 22 to provide additional support. The strong A-shaped support provided to the back at its hinges 32 and 34 is seen in FIG. 5. There is an additional unexpected advantage derived from the bendability of tongues 50 and 52, and this has to do with the fact that, when the book is opened, the spine of the book does not lie flat, i.e., in the same plane as the pages of the book but, rather the spine protrudes rearwardly from the book. This condition would present a dimensional problem, i.e., the maximum distance between the normal plane of the back 12 and the jaw 66 would be limited. However, with the illustrated device, jaw 66 presses the book spine against tongues 50 and 52 at their lower extremities and forces the tongues to bend rearwardly (as shown in an extreme conditio in FIG. 5) so as to accommodate the protruding spine. Thus, a book with a greater number of pages can be held effectively by the pressure of the book clamp against the front of the pages, while the protruding spine of the back of the book is accommodated by the rearwardly-bent tongues (as shown in use in FIG. 4), without requiring a greater size of book clamp 62 which would obscure the bottom lines on the pages and also interfere with its function as a book mark when it is closed.

Accordingly, book holder 10 is of broad utility and provides strong support, even though it can be inexpensively produced by injection molding of only one principal part.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A book holder comprising:

a substantially planar back for the support of a book thereon, said back having left and right edges, a top edge and a lower edge;

left and right slots in said back adjacent said left and right edges and a cross slot in said back spaced from said bottom edge, said cross slot intersecting said left and right slots, left and right support legs respectively positioned in said slots adjacent said left and right edges of said back, said left and right support legs each being pivoted with respect to said back, a foot secured without hinging to both said left and right support legs so that said foot extends from adjacent said left edge to adjacent said right edge for supporting said back at an acutely angular orientation with respect to a support surface when said foot and the lower portion of said support legs are swung out of their slots and when both said bottom edge of said back and said foot are engaged on the support surface, there being a downwardly directed tongue forming a part of said back with said tongue extending downwardly between said slots adjacent said left edge and said right edge;

a flange secured to said back and extending substantially from said left edge to said right edge of said back and extending forwardly from said back to act as a book stop, said flange being positioned adjacent said bottom edge of said back;

a clamp bar pivotably mounted on said flange, said clamp bar having a clamp jaw extending substantially from said left edge to said right edge of said back and extending above said flange and facing said tongue above said flange;

a spring interengaged between said back and said clamp bar to urge said clamp jaw towards said tongue to clamp a book against said tongue so that said tongue can resiliently bend backward from the clamping force of said clamp bar against a book.

2. The book holder of claim 1 wherein said back, said flange, said legs, said foot and said clamp bar are unitarily formed as a single part of injection molded thermoplastic synthetic polymer composition material.

3. The book holder of claim 2 wherein there is a thin molded section between said flange and said clamp bar so that said clamp bar is pivoted on a thin synthetic polymer web.

4. The book holder of claim 3 wherein a spring abutment rail is formed on the front of said back adjacent its bottom edge below said flange and a facing spring abutment rail is formed on the inside of said clamp bar below said flange and said spring engages said abutment rail.

5. The book holder of claim 4 wherein there is a flat spring having two ends which has one of its ends engaging one of said spring rail abutments and has its other end engaging the other of said spring rail abutments with the portion of said spring intermediate its ends bent upward towards said flange.

6. The book holder of claim 5 wherein said spring is made of resilient synthetic polymer composition material.

7. The book holder of claim 3 wherein said support legs are integrally molded with said back in the plane of said back and is bent out of the plane of said back to form said support legs, said support leg being attached to said back with a living hinge.

8. The book holder of claim 7 wherein a bracket is integrally molded with said legs in the plane of said back and is bent out of the plane of said back and away from said support legs and anchored to said back to hold said support legs in supporting position, said bracket being attached by means of a living hinge.

9. The book holder of claim 6 wherein said support legs are integrally molded with said back in the plane of said back and is bent out of the plane of said back to form said support legs, said support leg being attached to said back with a living hinge.

10. The hook holder of claim 9 wherein a bracket is integrally molded with said legs in the plane of said back and is bent out of the plane of said back and away from said support legs and anchored to said back to hold said support legs in supporting position, said bracket being attached by means of a living hinge.

11. A book holder comprising:

a substantially planar back having left and right edges and a bottom edge, said substantially planar back being molded of thermoplastic synthetic polymer composition material, said back having sufficient thickness so that it is sufficiently rigid and sufficiently strong to act as a rest against which a book may lie;

left and right support legs molded in the plane of said back and respectively molded in left and right slots in said back, said left and right slots respectively adjacent said left and right edges, said first and second support legs each being hinged adjacent the top thereof to said back by first and second living hinges;

a foot molded with said support legs and non-hingedly adjoining said support legs at the bottom of said support legs at the end thereof opposite said living hinges, said foot extending substantially from said left edge to said right edge and being molded in the plane of said back in a slot in said back extending from said slot which contains said left leg to said slot which contains said right leg;

a bracket molded in the plane of said back in a slot therein, said bracket being attached to said foot between said left and right support legs by a living hinge so that said foot and said support legs can be swung out of the plane of said back so that said legs and said bracket define left and right tongues extending downwardly from adjacent said hinged attachment of said left and right support legs to said top with said tongues terminating at their lower end at said slot in which said foot was molded so that said downwardly extending tongues can resiliently support the back of a book;

attachment means for detachably securing the end of said bracket opposite its living hinge to said back so that said support legs and said foot can be held in a supporting position away from said back so that said book holder can be supported on a surface with the bottom edge of said back and said foot engaging the surface to support said book holder; and a clamp jaw movably mounted on said back and positioned in front of said tongues, said clamp jaw resiliently urging a book toward said tongues so that said tongues can resiliently deflect to securely clamp a book across the entire length of said clamp jaw.

12. The book holder of claim 11 wherein said attachment means for detachably attaching said bracket to said back comprises at least one finger on said bracket and at least one recess in the front of said back so that said finger can be detachably entered in said recess to retain said bracket in place and thus retain said supporting legs in place.

13. The book holder of claim 12 wherein there are first and second fingers on opposite edges of said bracket adjacent the end opposite said hinge on said bracket and there are first and second recesses in the front of said back, said recesses being positioned on opposite sides of said slot in which said bracket was molded, at least one of said recesses having an opening smaller than the finger for insertion therein so that said finger is resiliently retained within its recess.

14. The book holder of claim 11 wherein there is a flange molded on the front of said back to serve as a stop for a book resting against said back.

15. The book holder of claim 14 wherein a clamp bar is pivotably mounted on said flange, said clamp bar having said clamp jaw thereon, and spring means engaged with said clamp bar for urging said clamp jaw towards said back above said flange for clamping a book between said clamp jaw and said back.

16. The book holder of claim 15 wherein said flange and said clamp bar are integrally molded with said back.

17. The book holder of claim 16 wherein there is a first spring abutment rail formed on said back adjacent its bottom edge below said flat and there is a second spring abutment rail formed with said clamp bar and facing said first spring abutment rail and there is a flat spring engaged on said abutment rails and bent upwardly towards said flange to urge apart said abutment rails and urge said clamp jaw in a clamping direction towards said back.

18. The book holder of claim 13 wherein there is a flange molded on the front of said back to serve as a stop for a book resting against said back.

19. The book holder of claim 18 wherein a clamp bar is pivotably mounted on said flange, said clamp bar having said clamp jaw thereon, and spring means engaged with said clamp bar for urging said clamp jaw towards said back above said flange for clamping a book between said clamp jaw and said back.

20. The book holder of claim 19 wherein said flange and said clamp bar are integrally molded with said back.

21. The book holder of claim 20 wherein there is a first spring abutment rail formed on said back adjacent its bottom edge below said flat and there is a second spring abutment rail formed with said clamp bar and facing said first spring abutment rail and there is a flat spring engaged on said abutment rails and bent upwardly towards said flange to urge apart said abutment rails and urge said clamp jaw in a clamping direction towards said back.

22. A book holder comprising:

a substantially planar back for the support of a book thereon, said back having left and right edges, a top edge and a lower edge, said back having left and right support leg slots therein respectively adjacent said left and right edges of said back and having a foot slot therein directed across said back spaced from its lower edge and interconnecting said left and right support leg slots;

left and right support legs integrally molded with said back in the plane of said back and respectively lying in said left and right support leg slots and a foot integrally molded with and connected to both said left and right support legs, said foot being molded in said foot slot and being non-hingedly joined with both of said support legs so that as said foot and said support legs are hinged rearwardly out of said slot, said foot lies in the plane of said support legs, said foot extending substantially from said left edge to said right edge so as to support said back when both said bottom edge of said back and said foot are engaged on a support surface;

a bracket integrally molded with said legs and said foot, said bracket lying in a bracket slot between said left and right support leg supports, said bracket being hingedly mounted with respect to said foot by means of a living hinge, said support leg slots, said foot slot and said bracket slot defining a pair of downwardly directed parallel tongues, said bracket being located initially parallel to and between said tongues, said tongues having unattached lower ends free of restraint and having upper ends integrally formed with said back so that said lower tongue ends will deflect rearwardly arcuately about said upper tongue ends in response to book force; and a clamp jaw movably mounted on said back and facing said tongues, said clamp jaw being resiliently urged toward said back to clamp a book between said clamp jaw and said back.

23. The book holder of claim 22 wherein said book force is caused by location of a book between said clamp jaw and said tongues, said book when open having a spine of greater dimensional thickness than the initial distance between said clamp jaw and said back, so that said spine applies said book force to said tongues, while the page thickness of said book applies opposing force to said clamp and said back.

24. The book holder of claim 22 wherein said book force is caused by location of a book between said clamp jaw and said back, said book force being due to book weight, said lower tongue ends being rearwardly arcuately deflectable until said lower tongue ends rest on said support surface.

* * * * *